US005154774A

United States Patent [19]

Bousquet et al.

[11] Patent Number: 5,154,774

[45] Date of Patent: Oct. 13, 1992

[54] PROCESS FOR ACID PICKLING OF STAINLESS STEEL PRODUCTS

[75] Inventors: Bernard Bousquet; Bernard Chetreff, both of Gueugnon, France

[73] Assignee: Ugine Aciers De Chatillon Et Gueugnon, Gueugnon, France

[21] Appl. No.: 816,845

[22] Filed: Dec. 31, 1991

Related U.S. Application Data

[63] Continuation of Ser. No. 541,471, Jun. 6, 1990, abandoned, which is a continuation of Ser. No. 057,913, filed as PCT/FR86/00267, Jul. 28, 1986, abandoned.

[51] Int. Cl.[5] ..... C23G 1/02

[52] U.S. Cl. ..... 134/3; 134/41; 134/10

[58] Field of Search ..... 134/3, 41, 10; 72/39; 29/DIG. 7, DIG. 25; 148/18

[56] References Cited

U.S. PATENT DOCUMENTS

| | | | |
|---|---|---|---|
| 2,337,062 | 12/1943 | Page | 134/3 |
| 2,474,526 | 6/1948 | Healy | 252/142 |
| 2,564,549 | 8/1951 | Stargardter | 134/3 |
| 2,856,275 | 10/1958 | Otto | 134/3 X |
| 3,310,435 | 3/1967 | Robinson Jr. et al. | 134/3 |
| 4,707,191 | 11/1987 | Martinou et al. | 134/3 |

FOREIGN PATENT DOCUMENTS

| | | | |
|---|---|---|---|
| 0188975 | 7/1986 | European Pat. Off. . | |
| 899890 | 12/1953 | Fed. Rep. of Germany . | |
| 3222532 | 12/1983 | Fed. Rep. of Germany . | |
| 2552465 | 4/1985 | France . | |
| 097229 | 4/1975 | Japan | 134/3 |
| 57-194262 | 11/1982 | Japan . | |
| 58-73778 | 5/1983 | Japan . | |
| 8001911 | 3/1980 | Sweden . | |
| 2000196 | 1/1979 | United Kingdom . | |

OTHER PUBLICATIONS

Monypenny, J. H. G., "Stainless Iron and Steel", vol. 1, 3rd edition (1951).

*Primary Examiner*—Olik Chaudhuri
*Assistant Examiner*—G. Fourson
*Attorney, Agent, or Firm*—Oblon, Spivak, McClelland, Maier & Neustadt

[57] ABSTRACT

The invention relates to a process for pickling stainless steel products, in which a pickling bath is used having the initial composition:

HF 10 to 50 g/l
Dissolved ferric iron ($Fe^{3+}$)≧15 g/l
Water: as required at a temperature of between 15°and 70° C., characterized in that, during the pickling operation(s), the ferric iron content of the bath is maintained at at least 15 g/l by oxidation of the bath comprising at least one or several injections of air in a total quantity greater than or equal to 1 $Nm^3$ per $m^2$ of pickled stainless steel and per hour of pickling of each unit of surface area pickled.

The process of the invention applies particularly to the industrial pickling of stainless steel sheets and strips, in which it is possible to avoid the use of nitric acid and the resulting pollution.

19 Claims, No Drawings

PROCESS FOR ACID PICKLING OF STAINLESS STEEL PRODUCTS

This application is a continuation of application Ser. No. 07/541,471, filed on Jun. 6, 1990, now abandoned, which is a continuation of Application Ser. No. 07/057,913, filed as PCT/FR86/00267, Jul. 28, 1986, now abandoned.

The scope of this invention is the surface treatment and more particularly the acid pickling or scaling of stainless steel products.

EXPLANATION OF THE PROBLEM

The acid pickling of stainless steels is usually performed using fluonitric baths, in which the disadvantage of using nitric acid is that it leads to the formation of nitrous vapours which pollute the atmosphere and soluble nitrates which pollute the liquid effluent.

In the context of the continuous acid pickling of stainless steel sheet, the Applicants have sought to perfect a modified pickling process which, while remaining industrially economical, limits or, better still, avoids such pollution.

KNOWN STATE OF THE ART

In his work "STAINLESS IRON AND STEEL" (CHAPMAN & HALL LTD, london 1951), J. H. G. MONYPENNY indicates (pp. 183–4) that, in order to minimize the problem of vapours from fluonitric pickling baths, stainless steel sheet has been pickled in baths containing from 6 to 12% of a 90% ferric sulphate solution and 1.5 to 3% of hydrofluoric acid, e.g. at 70°–80° C., in order to descale a hot-rolled sheet. The initial concentration of ferric iron in the baths used hitherto is thus from about 16.5 to 33 g/l. The Applicants' tests have shown that when successive samples of stainless steel sheet are pickled in baths of this kind, the rate and quality of pickling deteriorate rapidly. These acid pickling baths are therefore not satisfactory as such for serial or continuous pickling of stainless steel products.

It is also known to use pickling baths containing hydrofluoric acid and oxygenated water. Industrial pickling tests on strips of stainless steel have been carried out by the Applicants, who noticed temperature surges in the baths as well as a considerable consumption of oxygenated water, which made the process very expensive compared with the fluonitric process for pickling stainless steels. In this process, the replacement of nitric acid by oxygenated water therefore does not appear to be suitable for industrial application.

DESCRIPTION OF THE INVENTION

The invention relates to a process for pickling stainless steel products in which, as is already known, a pickling bath is used having the initial composition:

HF 10 to 50 g/l ferric iron ($Fe^{3+}$) dissolved $\geqq$ 15 g/l water: remainder at a temperature of between 15° and 70° C., and wherein, in novel manner, during the pickling operation or operations, the ferric iron content of the bath is maintained at at least 15 g/l by oxidation of the bath comprising at least one or several injections of air with a total flow rate of more than or equal to 1 $Nm^3$ per $m^2$ of pickled stainless steel and per hour of pickling of each pickled surface element, or an equivalent aeration by circulation in the open air. $Nm^3$ indicates a quantity of air under normal conditions, i.e., a temperature of 20° C. and atmospheric pressure.

For practical industrial use and particularly for repeated or continuous pickling of stainless steel products in at least one large vat, typically one or more pickling baths will be used, initially containing 10 to 35 g/l of HF and $\geqq$20 g/l of $Fe^{3+}$, and during the pickling operation or operations the $Fe^{3+}$ content of this bath or these baths is maintained at at least 20 g/l by oxidation of the or each bath, comprising one or more injections of air with a total flow rate of between 1 and 8 $Nm^3$ per $m^2$ of pickled stainless steel and per hour of pickling of each pickled surface element. Air injections with a higher total flow rate have proved pointless, as the bath certainly becomes saturated with oxygen from the air and additional flow rates of air apparently serve only to agitate the bath, possibly excessively.

The oxygen from the air fed in seems to participate in the process of the invention as an oxidizing agent which regenerates $Fe^{2+}$ into $Fe^{3+}$, whereas $Fe^{3+}$ constitutes an oxidizing agent acting on the base metal to dissolve it. The essential reactions might be as follows:

reaction of dissolution:

$$2Fe^{3+} + Fe \underset{2}{\overset{1}{\rightleftharpoons}} 3Fe^{2+} \qquad (A)$$

equilibrium almost totally shifted in direction 1 under normal pickling conditions;

other reaction of dissolution:

$$Fe + 2HF \rightleftharpoons H_2 \nearrow + FeF_2 \qquad (B)$$

also possible in an oxidizing medium, which is the case;

oxidation of $Fe^{2+}$ by aeration of the pickling solution, possibly supplemented by another means of oxidation:

$$4Fe^{2+} + O_2 + 4H^+ \underset{4}{\overset{3}{\rightleftharpoons}} 4Fe^{3+} + 2H_2O \qquad (C)$$

equilibrium strongly shifted in direction 3 if the solution is correctly oxidized and if the pH of the pickling bath is between about 1 and 3.

The ferric iron content of the bath can be calculated as the difference between the total iron concentration, measured by atomic absorption, for example, and the $Fe^{2+}$ concentration measured by its oxidation into $Fe^{3+}$ in the presence of permanganate $KMnO_4$. Suitable aeration of the pickling bath, typically by injection of air, makes it possible to maintain the quality of pickling in the course of successive pickling operations or continuous pickling of stainless steel products, while regenerating $Fe^{3+}$.

The total volume of air injected into the pickling bath depends essentially on the quantity of stainless steel pickled, whilst this quantity is itself proportional to the surface area pickled and the duration of pickling of this surface. For the pickling operation under consideration, and according to the industrial tests and modifications already carried out, the total quantity of air injected into the pickling bath of the invention is typically between 2 and 5 $Nm^3$ per $m^2$ of pickled stainless steel and per hour of pickling of each surface element pickled. So that the pickling bath should be properly aerated, it is advisable to inject a good proportion of this volume of air, typically at least half of this volume, with nozzles directed towards the bottom of the bath in the lower half of the bath. The air injected is preferably preheated to a temperature similar to that of the bath, i.e. typically between 35° and 60° C.

For industrial use of the pickling bath, recharging with HF is carried out in the usual manner and, rather than determining the $Fe^{3+}$ concentration of the bath, it is practical to determine the REDOX potential of the bath and regulate it between 0 and +800 mV, preferably between +100 and +300 mV if necessary by adjusting the oxidation of the bath. The reference REDOX potential is selected in accordance with the grade and surface condition of the strip and readjusted, if necessary, in accordance with observations of the surface condition after pickling.

The REDOX potential is measured between a platinum electrode and an Ag/AgCl reference electrode or a reference electrode with a fixed potential, reproducible and with zero power of irreversibility. A device for measuring this REDOX potential can be suitably made leaktight so that continuous measurements can be taken in the bath.

Depending on the $Fe^{3+}$ concentration found, or more conveniently depending on the value of the REDOX potential, there may be a need for an oxidation means which temporarily and/or locally supplements the action of the air in order to arrive more quickly at the desired $Fe^{3+}$ concentration or the set REDOX potential, so as to achieve good pickling. In this case, the addition of a strong oxidizing agent, e.g. oxygenated water or potassium permanganate, is used as the supplementary oxidising means. It is also possible to introduce an injection of oxygen or increase the flow rate of air in some cases.

In the case, which often arises in industry, where substantial quantities of stainless steel products are pickled in the same bath, small amounts of oxygenated water are preferably added to the bath in the form of constant or repeated additions, typically representing on average 0.1 to 0.4 l of $H_2O_2$ per $m^2$ of pickled stainless steel and per hour of pickling of each surface element pickled. Another oxidizing agent such as the potassium permanganate mentioned above may be used in just the same way. In the process according to the invention, the oxygen from the air injected is the main oxidizing agent and typically produces 90% of the oxidising action.

The Applicantion have found that it was possible to modify the solubility of the sludge or precipitate from the spent bath by regulating the REDOX potential of the bath during pickling. The "sludge" is not very soluble when the bath is regulated below +100 mV or above +300 to 350 mV, and its solubility is greatly improved at between +100 mV and +300 mV, more particularly between +190 mV and +260 mV, whilst the optimum setting for the bath is 220+−20 mV.

For a spent bath which has thus been used to pickle strips of stainless steel with a REDOX potential of between 200 and 240 mV, and containing about 60 g/l of iron in the form of "sludges" of precipitated fluorides, this sludge may be recycled into a new bath as follows: The liquid is sucked out of the spent bath, then hot water (50°-60° C.) is run onto the sludge to solubilise it, then the HF content is adjusted by adding free HF (15 to 20 g/l) and the whole is agitated. Then a little oxygenated water is added to adjust the potential to about 220 mV and a fresh bath is obtained. This possibility of recycling the sludge is particularly valuable on an industrial scale. As will be shown in Examples 3 to 5, it appears that this favourable dissolution of the sludge is linked to the precipitation of a mixed iron fluoride, the majority of which is formed between +100 mV and +300 mV and more particularly between +190 mV and +260 mV.

The pickling bath is generally prepared using ferric fluoride or ferric sulphate or ferric chloride, with a ferric iron concentration of between 20 and 40 g/l, with a preference for ferric fluoride, so that there is only one acid radical in the bath.

The pickling process according to the invention is used for stainless steel sheets or strips, typically with the following initial HF concentrations and pickling temperatures:

ferritic stainless steels: HF 10 to 25 g/l, 35°-50° C.

austenitic stainless steels: HF 20 to 35 g/l, 40°-60° C.

Apart from solving the pollution problem set, the pickling process according to the invention brings about major advantages for industrial exploitation:

regulation of the quality of the bath is all the more convenient and accurate as the majority of the oxidation is effected by the or each injection of air;

regulation of the level of the oxidation reduction potential makes it possible to obtain "sludges" which can be re-used directly in the form of a new bath.

TEST AND EXAMPLES

Test series no. 1

The aim of this was to test the qualitative effect of an air injection, either with or without a supplementary injection of oxygenated water. The pickling tests were carried out on samples of ferritic stainless steel containing 17% Cr of the AISI 430 type, hot-rolled, shot-blasted and pickled electrolytically, in the form of rectangular test-pieces measuring 50×25×3 mm.

The pickling conditions for these samples were as follows:

HF concentration: 20 g/l
volume of bath: 250 ml
time of immersion of sample in bath: 2 minutes
initial concentration of dissolved iron (ferric fluoride) varying from 0 to 60 g/l
$H_2O_2$ concentration from 0 to 5 g/l
air injected into solution, or not
temperature: 45° C.

This air injection was of the order of 1 l/min, i.e. well in excess relative to the useful flow rate.

For each condition, 3 to 5 samples were pickled successively. The quality of pickling obtained was evaluated qualitatively by examination with a binocular microscope with a magnification of 25, marks being given from 0 to 5:

0: no pickling
1: start of pickling, irregular
3: acceptable, fairly regular pickling
5: very good quality pickling.

The main marks obtained, corresponding to the 3rd samples for various conditions, are summarised in TABLE I below:

| Initial iron concentration ($Fe^{3+}$) g/l | without $H_2O_2$ | | with 2 g/l $H_2O_2$ | |
|---|---|---|---|---|
| | without air injection | with air injection | without air injection | with air injection |
| 0 | — | — | 1 | 1 |
| 5 | 1 | 2 | 1 | 3 |
| 10 | 1 | 2 | 2 | 5 |
| 20 | 2 | 3 | 3 | 5 |
| 30 | 2 | 4 | 3 | 5 |
| 60 | 5 | 5 | 5 | 5 |

These tests show that, without the addition of oxygenated water, the air injection improves the quality of pickling between 5 and 30 g/l of $Fe^{3+}$ dissolved and that the quality of pickling is thus acceptable above 15 to 20 g/l of $Fe^{3+}$ and good above 25 to 30 g/l of $Fe^{3+}$. Combined with the addition of just 2 g/l of oxygenated water, the air injection here makes it possible to obtain very good pickling upwards of 10 g/l of $Fe^{3+}$. With 60 g/l of $Fe^{3+}$ the shortness of the tests makes it impossible to observe any effect of wear on the baths, and the uniformity of the mark "5" in the various cases does not lead to any practical conclusion other than that the initial conditions were satisfactory.

Test series no. 2

In the laboratory, consecutive pickling tests were carried out on several hundred samples similar to the samples in test series no. 1, still in the same pickling solution with an initial HF composition of 20 g/l, with periodic refills of HF, on the one hand, to maintain a level of 20 g/l, and of $H_2O_2$, on the other hand, the minimum quantity necessary, in view of the iron concentration in the solution, with injection of air into the pickling bath.

The total concentration of dissolved iron, the comulative HF consumption and the cumulative consumption of oxygenated water $H_2O_2$ as a function of the number of samples pickled were followed, each for 2 minutes. It was noted that, up to 275–300 samples pickled, corresponding to 25–27 g/l of dissolved iron, the HF and $H_2O_2$ consumptions are fairly high and more or less proportional to the number of samples pickled, and beyond this the consumption of HF and $H_2O_2$ becomes very low. Thus, when the concentration of dissolved iron exceeds 25 g/l, the consumption of 70% concentrated HF surprisingly drops from 7 ml per 100 samples pickled to 0.3 ml per 100 samples pickled.

The explanatory hypotheses are as follows: The oxygen from the air injected into the bath acts as an ion regenerator ($Fe^{3+}$) according to the equilibrium reaction (C) given above, shifting this equilibrium in direction 3 towards forming $Fe^{3+}$, the pH of the solution being favourable and of the order of 2, owing to the HF concentration. If this reaction (C) is regulated so as to permit sufficiently fast regeneration of $Fe^{2+}$ into $Fe^{3+}$ so that the quantity of $Fe^{3+}$ is always greater than 20 to 25 g/l, there is virtually no need for $H_2O_2$. And the HF consumption is surprisingly much lower than for lower concentrations of iron and hence of $Fe^{3+}$.

EXAMPLE 1

Pickling according to the invention

The following conditions were found to be satisfactory for the continuous pickling of ferritic stainless steel strips containing 17% Cr and measuring 1 m wide. The strips were pickled in a vat 16 m long and 2 m wide containing about 30,000 l of acid pickling bath, and they passed through this bath at the rate of 20 m/min and were then brushed under water.

The bath contained 20 g/l of HF and to begin with 25 g/l of $Fe^{3+}$, coming from ferric flouride dissolved in the bath. Air was injected into the bath mainly with nozzles spaced 2 to 3 m apart and directed towards the bottom at an angle of 15° to the vertical, the air being released at the bottom of these nozzles towards the base of the vat and at 15 cm from this base. The total quantity of air injected into the bath was 100 $Nm^3/h$, two-thirds of which was towards the bottom and near the bottom by means of the nozzles described above. The bath temperature was 40° to 45° C. The bath was controlled by measuring the REDOX potential and maintaining it above +150 mV. The addition of oxygenated water was provided for, in order to correct this potential quickly should it become too low. In practice, the bath was able to operate up to 3 days in succession with a satisfactory REDOX potential without adding any $H_2O_2$. Moreover, it was noted that the pickling was still satisfactory at a REDOX potential of +100 'mV.

In 1 hour, the total surface of strip pickled is $20\times2\times1\times60=2400$ $m^2$/hour and the pickling time for each unit of surface area is $16/20=0.8$ min$=0.8/60$ hours. The total amount of air injected is thus:

$$100\ Nm^3 \text{ per } 32\ m^2\times h$$

i.e. 3.1 $Nm^3$ per $m^2$ of stainless steel pickled and per hour of pickling of each unit of surface area pickled.

EXAMPLE 2

Pickling according to the invention

This relates to the continuous pickling of austenitic stainless steel strips 1.25 m wide and 0.8 mm thick. After treatment in electrolytic baths, the strips were pickled in two successive vats having the same dimensions as the one in Example 1, containing about 30,000 l of pickling bath, and they passed through these baths at 40 m/min, giving a retention time in each bath of 0.4 min.

The baths contained 25 g/l of HF and, to begin with, 20 g/l of $Fe^{3+}$. Air was injected with nozzles arranged similarly to those in Example 1, with a total flow for each vat of 80 $m^3/h$ and a pressure of 0.2 MPa, i.e. a delivery of about 160 $Nm^3/h$. The temperature of the bath was 50° to 55° C.

The bath was controlled by measuring its REDOX potential and maintaining it at above +200 mV. The addition of oxygenated water was provided for as an additional oxidizing means for readjusting the REDOX potential if it fell too low. The bath was able to operate for periods of 3 days or more without using this additional oxidizing means and while maintaining a REDOX potential of +200 to +300 mV with a good pickling quality. The quantity of air injected in this case is 4 $Nm^3$ per $m^2$ of stainless steel pickled and per hour of pickling of each unit of surface area pickled.

EXAMPLE 3

Pickling according to the invention

Austenitic stainless steel strips were pickled, with the following modifications compared with Example 2:

HF 35 g/l

REDOX potential: +350 to +400 mV

Dissolved iron: 60 g/l, of which about 80% is $Fe^3$. The complex formed is of the FeF3, $3H_2O$ type. It was found that this compound was not soluble either in water at 20° C. nor in an aqueous solution containing 20 g of HF per liter at 20° C. (it hydrolyzes therein). On the other hand, it is moderately soluble at 50° C.: 31 g/l in water and 38 g/l in HF (20 g/l). This dissolution, which is unstable on cooling, is not satisfactory.

EXAMPLE 4

Pickling according to the invention

Same pickling conditions, except that the REDOX potential is +50 to +80 mV. $Fe^{2+}$ represents about 80% of the dissolved iron, and the complex formed is of the $FeF_2$, $nH_2O$ type. The same dissolution tests were carried out as in Example 3. This compound is not very soluble, and the only dissolution observed is 13 g/l in the case of HF (20 g/l) at 50° C.

EXAMPLE 5

Pickling according to the invention

The pickling conditions correspond to those of Example 2, with the exception of the REDOX potential maintained at +220 mV + −20 mV (measured between a platinum electrode and an Ag/AgCl reference electrode). $Fe^{3+}$ represents 70 to 80% of dissolved iron, and the main compound formed appears to be of the $Fe_2F_5$, 7 $H_2O$ type. The dissolution tests yielded the following results, in dissolved g per liter:

| Solubility at 20° C. | | Solubility at 50° C. | |
|---|---|---|---|
| in water | in HF solution 20 g/l | in water | in HF solution 20 g/l |
| 22.3 | 26 | 53 | 61 |

This type of sludge can be recycled into a new bath, using the method described hereinbefore.

We claim:

1. A process for pickling a stainless steel product, in which the pickling bath used has a composition consisting essentially of HF present in an amount of from 10 to 50 g/l, dissolved $Fe^{3+}$ ions present in an amount of at least 15 g/l, and water as the remainder, wherein said $Fe^{3+}$ ions originate from ferric fluoride so that said bath contains only F as acid radicals, wherein said process is carried out at a pickling bath temperature of between 15° and 70° C. and wherein, during the pickling operation, air is injected into said bath in a total amount greater than or equal to 1 $Nm^3$ per $m^2$ of stainless steel pickled per hour, wherein further, the redox potential of said bath is maintained between +100 mV and +300 mV by adjusting, if necessary, the oxidation state of said bath by intermittent addition of an additional oxidizing agent, maintaining consequently the $Fe^{3+}$ ion content in said bath to at least 15 g/l, and obtaining a soluble sludge.

2. The process of claim 1, wherein said pickling bath initially contains HF in an amount of from 10 to 35 g/l and $Fe^{3+}$ in an amount of at least 20 g/l, wherein the $Fe^{3+}$ content in said bath is maintained at a level of at least 20 g/l by oxidation of said bath, and wherein the amount of air injected is between 1 and 8 $Nm^3$ per $m^2$ of stainless steel pickled per hour.

3. The process of claim 2, wherein a total of from 2 to 5 $Nm^3$ of air per $m^2$ of pickled stainless steel per hour is injected into said bath, wherein, of said 2 to 5 $Nm^3$ of air per $m^2$ and per hour, at least half is injected towards the bottom of said bath, in the lower half of said bath.

4. The process of claim 1, in which said redox potential is maintained between +190 mV and +260 mV.

5. The process of claim 1, wherein said pickling bath is prepared with an initial concentration of $Fe^{3+}$ ions of 20 to 40 g/l.

6. The process of claim 1, in which $H_2O_2$ or potassium permanganate is used as the additional oxidizing agent in said bath.

7. The process of claim 6, in which 0.1 to 0.4 liter of $H_2O_2$ is used, as the sole additional oxidizing agent for said bath, per $m^2$ of pickled stainless steel per hour.

8. The process of claim 1, wherein ferritic stainless steel sheets or strips are pickled, and wherein the initial HF concentration of said pickling bath is from 10 to 25 g/l, and wherein said pickling bath temperature is between 35° and 50° C.

9. The process of claim 1, wherein austenitic stainless steel sheets or strips are pickled, wherein the initial HF concentration of said pickling bath is from 20 to 35 g/l, and wherein said pickling bath temperature is between 40° and 60° C.

10. The process of claim 1, wherein, after said pickling is finished, said sludge of the spent bath is recycled by sucking the liquid out of said spent bath, running hot water over said sludge to solubilize the same, adjusting the HF content by adding free HF and agitating the mixture obtained, and adding an amount of $H_2O_2$ sufficient to adjust the potential of said bath to between +200 and +240 mV, to obtain a fresh pickling bath.

11. The process of claim 10, wherein:

(a1) said air injected into said bath is injected at a total flow rate of between 2 and 5 $Nm^3$ per $m^2$ of stainless steel pickled and per hour of pickling of each unit of surface area pickled;

(a2) 0.1 to 0.4 liter of $H_2O_2$ per $m^2$ of stainless steel pickled and per hour of pickling of each unit of surface area pickled is used as the sole additional strong oxidizing agent;

(a3) said redox potential of said pickling bath is maintained to +190 and +260 mV; and (b) for said recycling said sludge from said spent pickling bath, water having a temperature from 40° to 60° is used.

12. A process for pickling a stainless steel product, in which the pickling bath used has a composition consisting essentially of HF, dissolved $Fe^{3+}$ ions, and water as the remainder, wherein said $Fe^{3+}$ ions originate from ferric fluoride so that said bath contains only F as acid radicals, wherein, during the pickling operation, air is injected into said bath in a total amount greater than or equal to 1 $Nm^3$ per $m^2$ of stainless steel pickled per hour, wherein further, the redox potential of said bath is maintained between +100 mV and +300 mV by adjusting, if necessary, the oxidation state of said bath by intermittent addition of an additional oxidizing agent, maintaining consequently the $Fe^{3+}$ ion content in said bath to at least 15 g/l, and obtaining a soluble sludge.

13. The process of claim 12, wherein the $Fe^{3+}$ content in said bath is maintained at a level of at least 20 g/l by oxidation of said bath, and wherein the amount of air injected is between 1 and 8 $Nm^3$ per $m^2$ of stainless steel pickled per hour.

14. The process of claim 13, wherein a total of from 2 to 5 $Nm^3$ of air per $m^2$ of pickled stainless steel per hour is injected into said bath, wherein, of said 2 to 5 $Nm^3$ of air per $m^2$ and per hour, at least half is injected towards the bottom of said bath, in the lower half of said bath.

15. The process of claim 12, in which said redox potential is maintained between +190 mV and +260 mV.

16. The process of claim 12, in which $H_2O_2$ or potassium permanganate is used as the additional oxidizing agent in said bath.

17. The process of claim 12, wherein ferritic stainless sheets or strips are pickled, and wherein the pickling bath temperature is between 35° and 50° C.

18. The process of claim 12, wherein austenitic stainless sheets or strips are pickled, and wherein the pickling bath temperature is between 40° and 60° C.

19. The process of claim 16, in which 0.1 to 0.4 liter of $H_2O_2$ is used, as the sole additional oxidizing agent for said bath, per $m^2$ of pickled stainless steel per hour.

* * * * *

UNITED STATES PATENT AND TRADEMARK OFFICE

CERTIFICATE OF CORRECTION

PATENT NO. : 5,154,774

DATED : October 13, 1992

INVENTOR(S) : Bernard Bousquet et al.

It is certified that error appears in the above-identified patent and that said Letters Patent is hereby corrected as shown below:

On Title page, Item [63], Related U.S. Application Data, please correct to read as follows:

--Continuation of Ser. No. 541,471, Jun. 6, 1990, abandoned, which is a Continuation of Ser. No. 057,913, Jun. 23, 1987, abandoned--, and Item [30], Foreign Application Priority Data has been omitted, please insert as follows: --Sep. 19, 1985 [FR] France.....85-14220

Jul. 28, 1986 [PC] PCT.....PCT/FR86/00267--.

Signed and Sealed this

Nineteenth Day of October, 1993

*Attest:*

Bruce Lehman

BRUCE LEHMAN

*Attesting Officer*

*Commissioner of Patents and Trademarks*